US005186804A

United States Patent [19]

Ford et al.

[11] Patent Number: 5,186,804

[45] Date of Patent: Feb. 16, 1993

[54] LIQUID METAL CATHODE ELECTROCHEMICAL CELL

[75] Inventors: James M. Ford; David W. Cawlfield; Kenneth E. Woodard, Jr., all of Cleveland, Tenn.

[73] Assignee: Olin Corporation, Cheshire, Conn.

[21] Appl. No.: 755,401

[22] Filed: Sep. 5, 1991

[51] Int. Cl.[5] ..... C25B 9/00; C25B 15/08

[52] U.S. Cl. ..... 204/251; 204/279

[58] Field of Search ..... 204/251, 279, 219-220, 204/250

[56] References Cited

U.S. PATENT DOCUMENTS

| | | | |
|---|---|---|---|
| 727,025 | 5/1903 | Tafel | 204/101 |
| 2,242,477 | 5/1941 | Osswald et al. | 204/101 |
| 4,036,714 | 7/1977 | Spitzer | 204/251 X |
| 4,101,407 | 7/1978 | Hilare et al. | 204/251 |
| 4,556,470 | 12/1985 | Samejima et al. | 204/251 X |
| 4,586,994 | 5/1986 | Samejima et al. | 204/251 X |
| 4,596,639 | 6/1986 | Nishio et al. | 204/251 X |
| 4,849,073 | 7/1989 | Dotson et al. | 204/101 |

OTHER PUBLICATIONS

Article entitled "Hydroxylamine Production by Electroreduction of Nitric Oxide in a Trickle Bed"-The Canadian Journal of Chemical Engineering, vol. 57, Oct., 1979.

*Primary Examiner*—Donald R. Valentine

*Attorney, Agent, or Firm*—Ralph D'Alessandro; F. A. Iskander

[57] ABSTRACT

A particular side frame design for use in an electromechanical cell with a catholyte flow pattern is disclosed wherein the cell is angled from the horizontal and the catholyte is fed into a gap in the cathode compartment between the liquid metal cathode and the membrane on the lower first end and exits the gap on the opposing higher second outlet end. The side frame is obliquely angled on the interior of the cell to prevent the escape of the flowable liquid metal cathode and to prevent contact of the acidic catholyte with the cell bottom.

18 Claims, 3 Drawing Sheets

LIQUID METAL CATHODE ELECTROCHEMICAL CELL

BACKGROUND OF THE INVENTION

The U.S. Government has rights in this invention Pursuant to Contract No. DAAA 15-89C-0011 awarded by the Department of Army. Under this contract, the U.S. Government has certain rights to practice or have practiced on its behalf the invention claimed herein without payment of royalties.

The present invention relates to an electrochemical cell for use in the production of aqueous solutions of inorganic chemicals and Preferably hydroxylamine compounds. More particularly, the present invention relates to the design of the anode side frame and the particular complex curvature employed adjacent the cathode end boxes in the electrochemical cell which may be used in the production of aqueous solutions of hydroxylamine nitrate and other inorganic or organic chemicals using electrochemical reduction at a liquid metal surface.

Hydroxylamine nitrate is employed in the purification of plutonium metal, as one component of a liquid propellant, and as a reducing agent in photographic applications. In some of these applications a highly pure form of the compound is required.

Previous electrolytic processes have electrolyzed nitric acid solutions containing mineral acids such as sulfuric acid or hydrochloric acid to form hydroxylamine salts of these acids. The processes were carried out in an electrolytic cell having high hydrogen overvoltage cathodes, such as mercury or an alkali metal amalgam, with a diaphragm or membrane separating the cathode from the anode.

The hydroxylamine salt produced by the electrolytic processes of the prior art can be converted to hydroxylamine nitrate at low solution strength and in an impure state. One method is by electrodialysis as taught by Y. Chang and H. P. Gregor in Ind. Eng. Chem. Process Des. Dev. 20, 361–366 (1981). The double displacement reaction employed requires an electrochemical cell having a plurality of compartments and requiring both anion exchange and cation exchange membranes or bipolar membranes with significant capital costs and high energy costs.

U.S. Pat. No. 4,849,073 issued Jul. 18, 1989 to the assignee of the present invention disclosed a process and electrochemical cell to directly produce a concentrated hydroxylamine nitrate solution. A mercury-containing cathode was used on top of a conductive plate that was also the top of the cooling compartment. This design entailed the use of additional space for the separate cooling compartment and did not provide against the possible loss of the mercury-containing cathode from the cell.

Electrolytic cell designs using liquid mercury cathodes have long been employed to produce chlorine and caustic in what are known as chlor-alkali cells In these chlor-alkali cells the mercury amalgam is removed from the cells to make the product caustic by a secondary reaction in what is known as a "decomposer".

Where membranes are used in the electrolytic cell, it is essential that wrinkling be avoided and a liquid-tight seal be obtained between the membrane and the anode and cathode structure. Further, where the flowable liquid metal cathode is employed, the design must ensure that the liquid metal cathode does not escape from the cell into the surrounding environment.

These and other problems are solved by the design of the present invention whereby an electrochemical cell is provided that is able to operate under pressure and is angled from the horizontal to permit gas bubbles to escape from the surface of the membrane separator while the differential pressure holds the membrane in place and the anode side frame design, in combination with the flow pattern of catholyte through the cathode compartment, prevents the liquid metal cathode from leaving the cell.

SUMMARY OF THE INVENTION

It is an object of the present invention to provide a catholyte flow pattern and flow rate across an angled electrolytic cell with a flowable liquid metal cathode to maintain the liquid metal cathode at a generally static level in the catholyte chamber and prevent its flowing out of the cell catholyte compartment.

It is another object of the present invention to provide a side frame design that prevents the liquid metal cathode from flowing out of the low end of the cell while permitting the electrochemical reduction of the chemical in the catholyte on the liquid metal cathode to occur.

It is still another object of the present invention to provide a side frame design that permits the membrane to be sealed between the anode and the cathode compartments in a liquid-tight and substantially wrinkle free manner.

It is a feature of the present invention that the cathode side frame has an obliquely angled portion that prevents both the corrosive catholyte acid from contacting the cell bottom and the flowable liquid metal cathode from flowing out of the cell while the cell is operated angled on a grade of less than about 5 percent, preferably less than about 3 percent and more preferably less than about 1 percent from the horizontal.

It is another feature of the present invention that the obliquely angled side frame design dampens any wave action created in the liquid metal cathode by the flow pattern and velocity of the catholyte that is circulated through the gap between the membrane and the liquid metal cathode in the electrolytic cell.

It is another advantage of the present invention that the liquid metal cathode is maintained at a generally static level within the cell with no appreciable loss of the liquid metal cathode outside of the cell.

It is a further advantage of the present invention that the corrosive catholyte is prevented from contacting the electrolytic cell bottom by the combined effect of the obliquely angled side frame and the presence of the liquid metal cathode.

These and other objects, features and advantages are provided in the design of the side frames of the electrolytic cell that is angled from the horizontal and has a flowable liquid metal cathode separated from the anode by a membrane that has a major portion positioned generally through an extended plane to define a gap between the liquid metal cathode and the membrane so that the catholyte is fed into the gap on a first lower inlet end and exits the gap on an opposing higher second outlet end such that the catholyte enters and leaves the gap above the level of the major portion of the membrane that is positioned in the extended plane.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
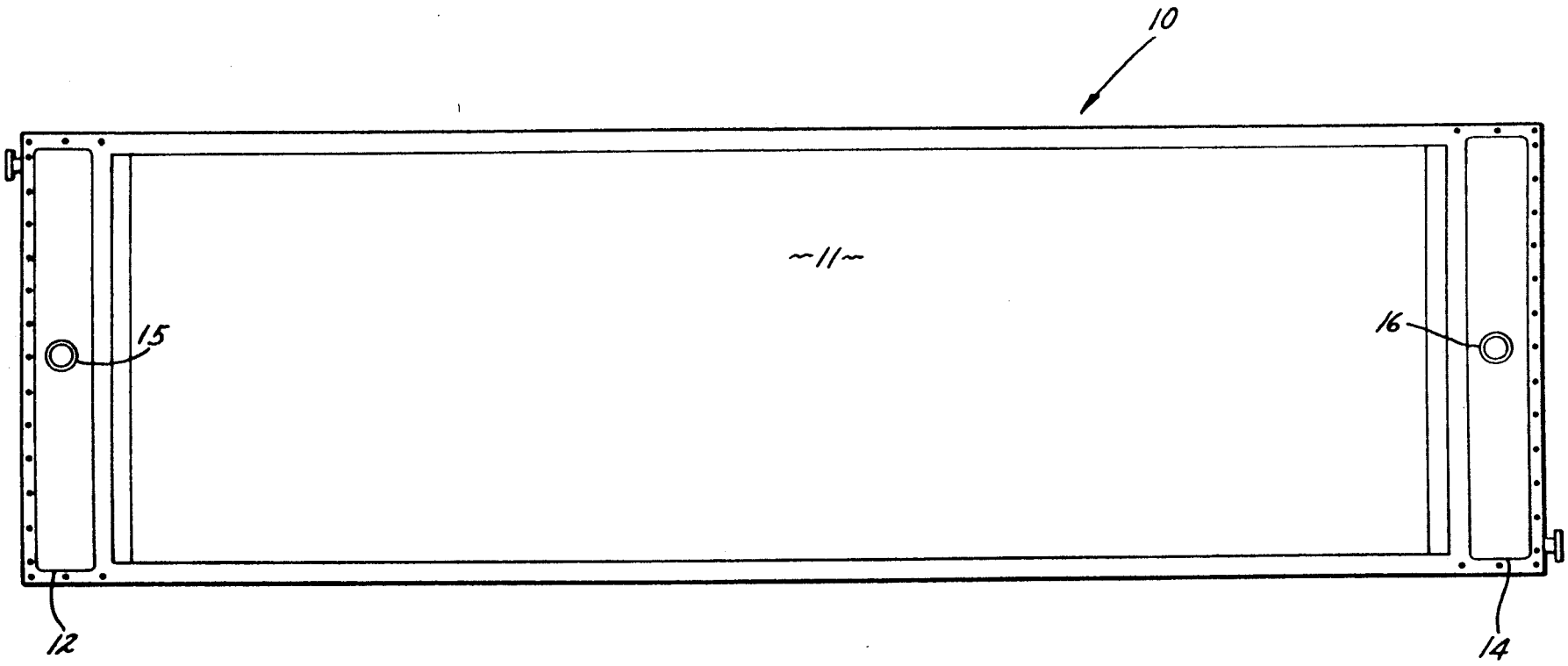
FIG. 1 is a bottom plan view of the electrochemical cell showing the catholyte end boxes on opposing ends of the cell.

FIG. 1 shows the cell bottom 11 of the electrolytic cell 10 used to produce desired chemicals employing an electrochemical reduction at the surface of a flowable liquid metal cathode. As seen in FIG. 1, the cathode inlet end box 12 and the cathode outlet end box 14 are shown in the lengthwise configuration of cell with a catholyte inlet feed pipe or header 15 and a catholyte outlet pipe or header 16 shown exiting their respective end boxes.

Figure 2:
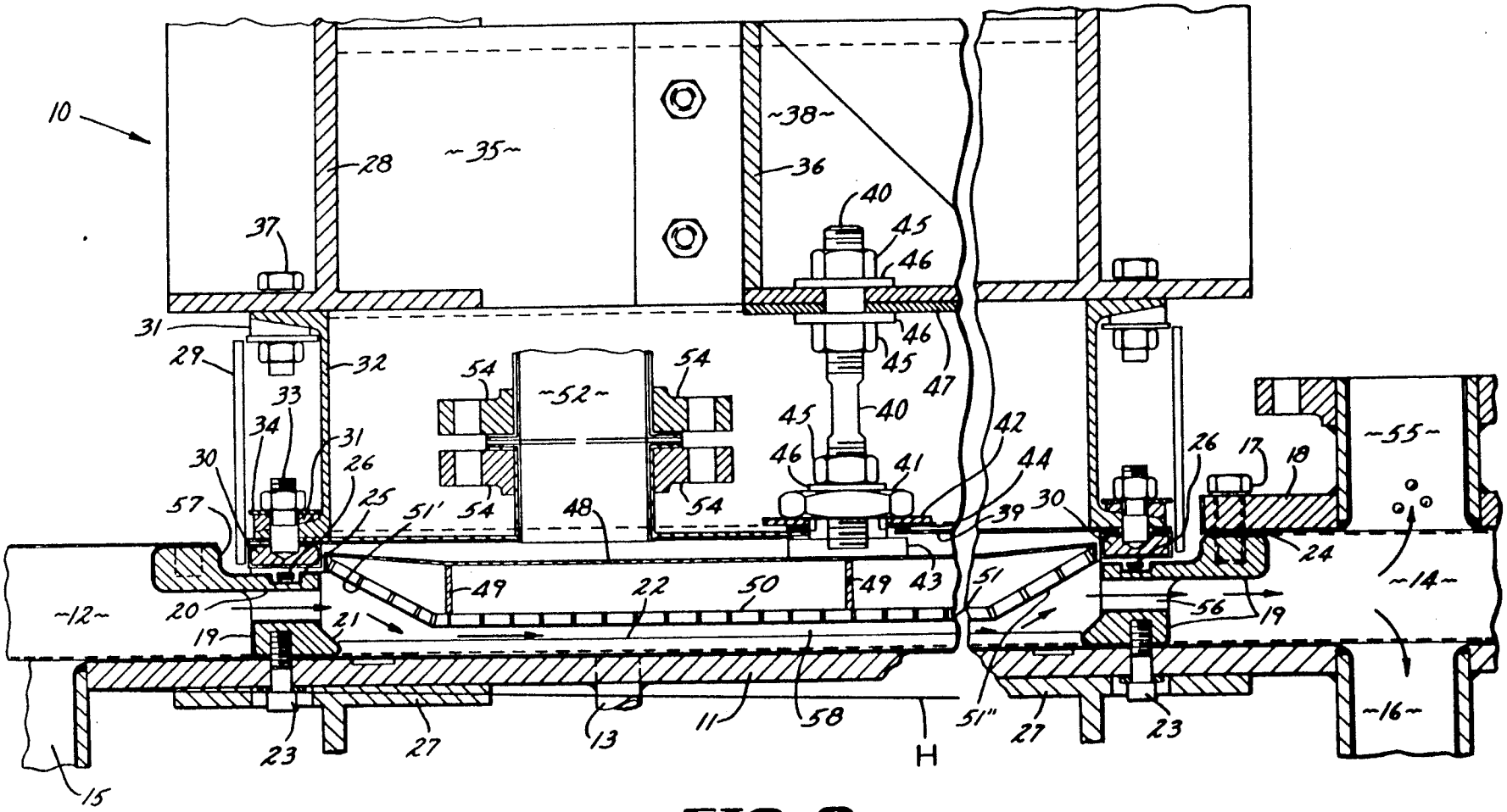
FIG. 2 is a side sectional elevational view of the cells showing the catholyte flow pattern from the inlet side through the outlet side of the cell.

The sectional view through the cell shown in side elevational fashion in FIG. 2 illustrates the catholyte flow pattern. As seen in FIG. 2 the catholyte enters and exits the catholyte compartment in the cell 10 at a level above the major portion of the membrane 51 and is positioned across an extended plane between the first lower inlet end passage 20 and the opposing higher second outlet end passage 56. Catholyte is fed into the cathode inlet end box 12 via an appropriate fitting, such as the catholyte inlet feed pipe 15 and passes through the cathode side frame 19 via the lower first inlet end passage 20 into the gap 58 in the cathode compartment between the surface of the liquid metal cathode 22 and the cations permselective membrane 51. The gap 58 between the membrane 51 and the surface of the liquid metal cathode 22 is between about 5 to about 15 millimeters, more preferably is about 6 to about 13 millimeters, and most preferably is between about 7 to about 11 millimeters. The membrane 51 is held against the woven wire screen mesh anode 50 by differential pressure. This differential pressure, which can vary from as little as about 0.1 to as much about 4.0 pounds per square inch, creates a generally uniform flow gap between the membrane 51 and the liquid metal cathode 22.

The anode can have a screen mesh welded to rods or members which can be made from tantalum or niobium. The mesh can be made from any noble metal or noble metal oxide coated on a substrate and, more preferably, a platinum clad niobium. Preferably the platinum is coextruded over a niobium wire.

A wide variety of cation exchange membranes can be employed containing a variety of polymer resins and functional groups, provided the membranes possess the requisite anion and gas selectivity, as well as preventing or minimizing the passage of excessive amounts of water from the anode compartment into the cathode compartment. Suitable cation exchange membranes are those which are inert, flexible, and are substantially impervious to the hydrodynamic flow of the electrolyte and the passage of any gas products produced in the anode compartment. Cation exchange membranes are well-known to contain fixed anionic groups that permit the intrusion and exchange of cations, and exclude anions, from an external source. Generally the resinous membrane or diaphragm has as a matrix a cross-linked polymer to which are attached charged radicals, such as $-SO_3=$, $-COO^-$, $-PO_3=$, $-HPO_2=$, $-AsO_3=$, and $-SeO_3-$ and mixtures thereof. The resins which can be used to produce the membranes include, for example, fluorocarbons, vinyl compounds, polyolefins, and copolymers thereof. Preferred are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid group" and "carboxylic acid groups" are meant to include salts of sulfonic acid or salts of carboxylic acid groups formulated by processes such as hydrolysis. Suitable cation exchange membranes are sold commercially by E. I. Dupont de Nemours & Co., Inc. under the trademark "NAFION", by the Asahi Glass Co. under the trademark "FLEMION", and by the Asahi Chemical Co. under the trademark "ACIPLEX".

The major portion of the membrane that is stretched across an extended plane between the lower first inlet end passage 20 and the opposing higher second outlet end passage 56 is illustrated by the numeral 51, while the obliquely angled portions of the membrane supported against the anode woven mesh screen mesh 50 adjacent the end boxes 12 and 14 on opposing sides of the cell 10 are indicated as 51'.

As best seen in FIG. 2, the catholyte enters through the side frame 19 via the lower first inlet end passage 20 and flows across the surface of the liquid metal cathode 22 beneath the membrane portions 51', 51 and 51'' until it exits the opposing higher outlet end 56. The flow rate of the catholyte across the liquid metal cathode is sufficient to maintain the temperature of the electrolytic cell 10 at a level to permit the product specific reactions to occur and to prevent product decomposition from occurring within the cell. The catholyte, upon leaving the cell 10 via the catholyte outlet 16 in end box 14, is circulated to a heat exchanger or chiller (not shown) to reduce the temperature to about 10° C. The flow rate of the catholyte required will depend upon the heat generated by the kiloampere current load at which the cell 10 is operated.

Further, the velocity of the catholyte increases in the area of the extended plane of the membrane 51. One of the challenges in scaling up from a laboratory scale production model to a commercial scale facility was the necessity to increase the length of the cell to have a longer flow path through the cell, but maintain the residence time of the electrolyte within the cell as a constant, even though the cell was longer. Therefore the velocity had to be increased without creating turbulent flow conditions that would break up the liquid metal cathode and carry it out of the cell cathode compartment.

In the instant design, it is critical that the force of the catholyte flowing through the cell directed toward the outlet end passage 56 of the cell is exactly counterbalanced by the force of the liquid metal directed toward the inlet end passage 20 of the cell 10 and is proportional to the difference in height between the exit and the inlet ends of the cell and the density of the liquid metal cathode. As seen in FIG. 2, the cell 10 is angled from the horizontal, which is indicated generally by the line designated H. The tilting of the entire cell, in combination with the catholyte flow rate, permits the liquid metal cathode to remain at a generally static level in the catholyte chamber and maintain the surface of the major portion of the membrane and the surface of the liquid metal cathode as generally parallel. Since the angle or tilt of the cell and the flow rate of the catholyte through the gap 58 between the membrane and the liquid metal cathode 22 are interrelated, one or both may have to be adjusted to maintain the parallel relationship of the surface of the liquid metal cathode 22 and the membrane portion 51. This particular configuration and flow velocity of the catholyte also permit any gas bubbles generated during electrolysis to be carried by the channel flow pattern from the inlet end passage 20 and through the outlet end passage 56 into the outlet end box 14 of the cell.

It is theorized that the flow pattern and velocity of the catholyte through the gap 58 creates an almost circular flow pattern within the liquid metal cathode 22 that causes the top surface of the liquid metal cathode 22 to move from the inlet end passage 20 toward the outlet end passage 56 because of the drag created on the top layer of the liquid metal cathode 22 while the bottom of the liquid metal cathode 22 moves in the opposite direction, flowing down the angled cell bottom 11 toward the inlet end passage 20. The catholyte is force flow circulated through the gap 58 in the catholyte compartment in the cell 10 at a flow rate of between about 75 to about 150 gallons per minute which produces a catholyte flow rate through the gap 58 of between about 1 to about 5 cubic meters per hour per square meter of cathode surface area and an average bulk flow velocity of about 0.1 to about 2 meters per second squared. This creates a flow with a Reynolds number between about 2000 and about 4000, which borders on turbulent flow.

This flow rate produces a flow pattern in the liquid metal cathode in which there are small waves that are choppy and move in multiple directions within the catholyte compartment, but no liquid metal is entrained in the outlet end passage 56. This is in contrast to a fully turbulent flow pattern where the waves of the liquid metal would be carried out and exit through the side frame 19 by the turbulent flow of catholyte. The high catholyte flow rate permits the omission of a space-consuming and costly cooling chamber or plate within the cell 10 and still permits the cell 10 to be operated with the catholyte maintained at a temperature of less than about 50° C.

Returning now to FIG. 2, it is seen that the catholyte end box 12 has a cover plate 18 that is retained in place by the retaining bolt 17. The side frame 19 has an upper portion that has machined therein a groove 25 in which is placed an O-ring 26 to accomplish sealing against the anode and frame member 30. A gasket 24 is placed between the cell top cover 18 and the upper side frame portion 57 of side frame 19. The lower portion of the side frame 19 is retained in place against the cell bottom 11 by frame cap screw 23. Cap screw 23 also secures a bottom frame support 27 to the cell bottom 11.

An obliquely angled or sloped side frame dam portion 21 of side frame 19 helps to retain the liquid metal cathode 22 in place and, in combination with the catholyte flow pattern, prevents its flowing out through the lower first inlet end 20. The obliquely angled side frame dam portion 21 is preferably inwardly angled, as shown in FIG. 2, but may also be outwardly angled. The oblique angle prevents the incursion of the corrosive acid catholyte into contact with the cell bottom 11 by ensuring that a layer of the liquid metal cathode 22 always coats the bottom 11 and overlaps part of the dam portion 21 of side frame 19. This oblique angle also helps to dampen any waves that may start to build-up in the surface of the liquid metal cathode 22 because of the flow rate of the catholyte that passes over its surface. Lastly, this oblique angle permits a large volume of catholyte to pass through the catholyte inlet passages 20 and the outlet end passages 56 in a cell operating at high pressure without having the flow passages yield or distort and destroy the liquid tight seal.

As previously indicated, the cell 10 is angled slightly from the horizontal over less than about a 5 percent grade, preferably less than about a 3 percent grade and most preferably about a 0.1 to about a 1% grade. The percent grade slope depends on the catholyte flow rate through the gap, with a higher flow rate employing a greater percent grade slope. The cell slope is adjusted by a plurality of adjustment bolts (not shown) across the cell bottom. The catholyte average bulk flow velocity inside the cell 10 the gap 58 between the liquid metal cathode 22 and the membrane 51 is preferably between about 0.1 to about 1 meter per second calculated by cross sectional area and measured as an average of the flow permitted across the length of the approximately 4 meter long cell. Preferably the cell is tilted at an angle that is equivalent to about an 11 millimeter rise over its 4 meter length. The catholyte flow thereby displaces the liquid metal in linear fashion by the uniform pressure drop of the flowing catholyte to obtain sufficient flow to clear any bubbles generated by the reaction off the membrane 51 and obtain the required mass transfer. The gas bubbles, if left to build up, can create blockage or gas blinding of the membrane. The flow rate is sufficient, however, to not create sufficiently high velocity jets that create turbulence in the liquid metal cathode and carry that liquid metal cathode out of the cell. Although described hereinafter as being a flowing mercury cathode, it is to be understood that any type of flowing liquid metal cathode could be employed which has a high hydrogen overvoltage, including the use of such metals as bismith and indium and alloys thereof.

As can be seen in FIG. 2, the anode end frame 30 is secured to a top clamping frame 32 via a frame retaining bolt 33 which employs a washer 34 and a gasket 31. The top clamping frame 32 sits atop the cell top 39, which is preferably formed of stainless steel with a PFA coating. The top clamping frame 32 is connected to a support beam 35 which employs an anode post securing frame 28 and a plurality of support L beams 36 across the top. The support beam 35 is fastened to the top clamping frame 32 via a beam retaining bolt 37 that employs a gasket 31 and a suitably sized hexagonal nut. Support L beams 36 can have gussets 38 to add additional support to the structure atop of the cell top 39. Within the anode compartment, anode support cross members 49 support the anode top 48 which is connected to electrode lead-in posts 40 (only one of which is shown) that are connected to copper bus 47. The electrode lead-in post 40 passes through the support L beam 36 and is retained in place by washers 46 and hexagonal nuts 45. The leading post 40 connects to the cell top 39 via a retaining nut 41, a lug washer 42 and a gasket 44 to provide a liquid-tight seal that permits current to be electrically conducted through the lead-in post 40 and a conductor pad 43 to the anode.

Once the catholyte has flowed through the gap between the liquid metal cathode 22 and the membrane extended plane portion 51, it exits the cell through the opposing higher second outlet end 56 into the cathode outlet end box 14. There any gas, such as hydrogen, which was generated and removed as bubbles from the surface of the membrane, exits through the catholyte end box gas pipe 55, while the catholyte is recirculated and exits through the catholyte outlet 16.

Figure 3:
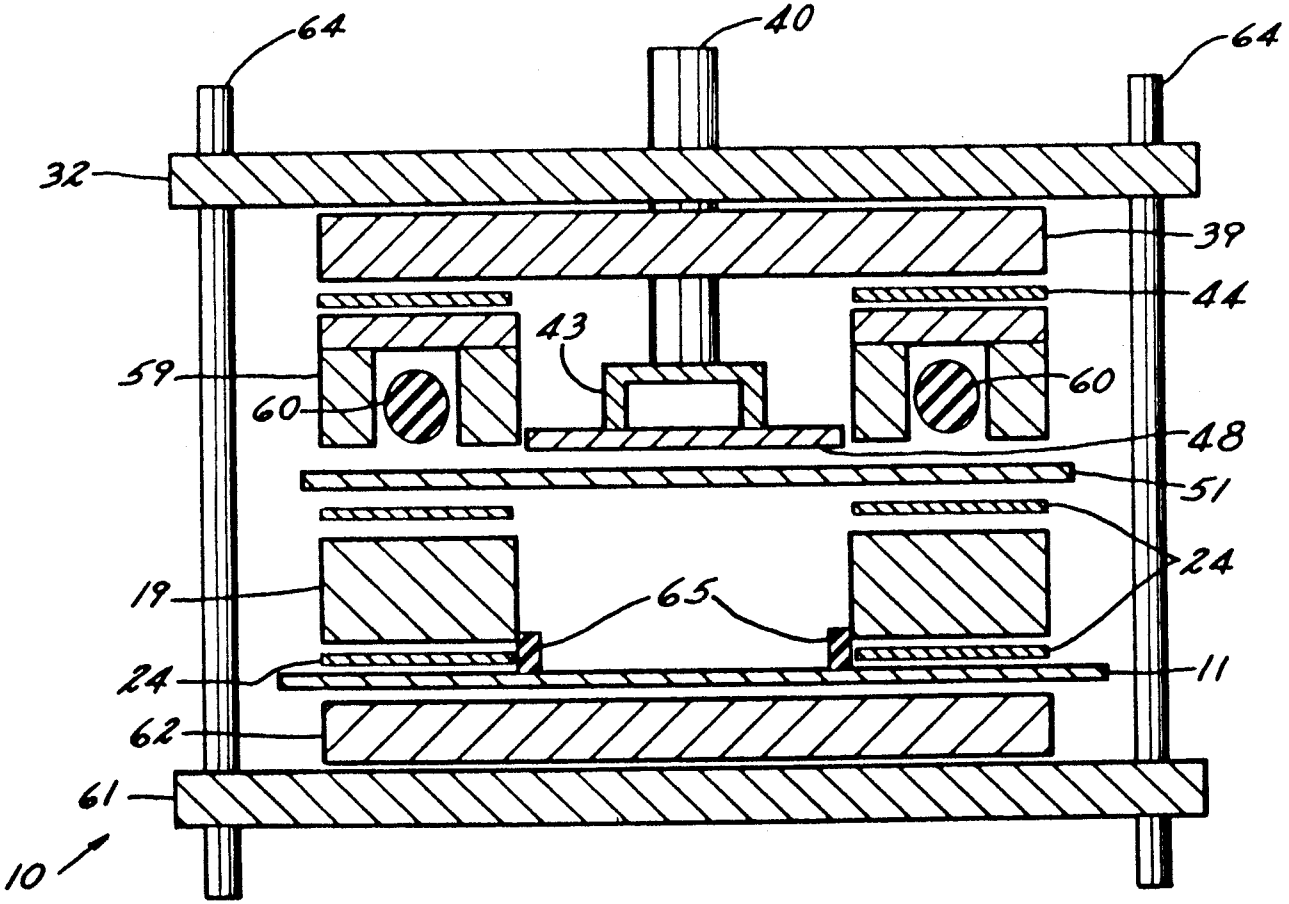
FIG. 3 is a diagrammatic exploded illustration of representative electrolytic cell design using the catholyte flow path of the present invention.

FIG. 3 is a diagrammatic illustration of cell 10 in a partially exploded view showing how the cell is clamped together by stainless steel upper clamping frame 32 and stainless steel bottom clamping frame 61 with tie bolts 64. The stainless steel PFA coated anode side frames 59 are sealed to the stainless steel PFA coated cell top 39 via GORETEX® gaskets 44 and to the membrane 51 via the use of EPDM O-rings 60 placed in channels within the side frames 59. The anode lead-in post 40 connects via conductor pad 43 to the anode top 48. GORETEX® gaskets 24 are placed above and below the stainless steel PFA coated cathode side frame 19 to seal the membrane and the HASTELLOY C alloy cell bottom 11. Gaskets 65 may be used along the interior of the cathode side frames 19 to assist in sealing to the cell bottom 11. A cell base plate 62 may be employed separately or may be integrated within the cell bottom 11.

Any gas, such as oxygen, generated within the anode chamber exits through the anolyte gas nozzle 52 that is connected to the cell top 39. The gas nozzle 52 can employ flanges 54 to retain multiple sections of the nozzle or pipe together.

Where hydroxylamine nitrate is the desired product to be produced, an aqueous solution of nitric acid is fed to the cathode compartment of the electrolytic cell 10. The aqueous solution may contain any concentration of $HNO_3$ which is suitable for electrolysis to produce hydroxylamine nitrate. Since nitric acid is a strong oxidizing agent, the catholyte solution in the cathode compartment should have a uniform or homogeneous concentration so that localized pH gradients can be controlled and high $NO_3$— levels do not lead to oxidation of the product. The catholyte solution is essentially free of other mineral acids, such as hydrochloric acid or sulfuric acid.

During electrolysis, the desired reactions at the cathode are thought to be as given in the following equations:

$$HNO_3+2H^++2e^-\rightarrow HNO_2+H_2O \quad (1)$$

$$HNO_2+4H^++4e^-\rightarrow NH_2OH+H_2O \quad (2)$$

(1) and (2) being summarized by:

$$HNO_3+6H^++6e^-\rightarrow NH_2OH+2H_2O \quad (3)$$

The hydroxylamine ($NH_2OH$) produced is then protonated for stabilization with $HNO_3$ according to the equation:

$$HNO_3+NH_2OH\rightarrow[NH_3OH]^+NO_3^- \quad (4)$$

While equations (3) and (4) are believed to indicate the stoichiometric amounts of nitric acid required to produce hydroxylamine nitrate during operation of the electrolytic process, an excess amount of nitric acid in the catholyte is maintained which is from about 0.1 to about 1.5, preferably from about 0.1 to about 0.8 and more preferably from about 0.2 to about 0.5 moles per liter.

In a preferred embodiment, the catholyte solution is continuously removed from and recirculated to the cathode compartment, following the supplemental addition of $HNO_3$ required to maintain the concentrations given above.

The catholyte solution temperature in the cathode chamber is maintained below about 50° C., for example, in the range of from about 5° to about 40° C., and preferably at from about 10° to about 25° C. If the temperature of the catholyte is above about 50° C. or if oxygen is present in the catholyte, the undesired formation of by-products such as nitrogen oxide, ammonia or nitrogen dioxide may occur, as represented by the equations:

$$NH_2OH\cdot HNO_3\rightarrow 2NO+2H_2O \quad (5a)$$

$$3NH_2OH\rightarrow NH_3+N_2+3H_2O \quad (5b)$$

$$4NH_2OH\rightarrow 2NH_3+N_2O+3H_2O \quad (5c)$$

The evolution of significant amounts of hydrogen gas is not desired. A preferred way to avoid this is to control the cathode half-cell potential. Suitable cathode half-cell potentials are those at about or below the hydrogen overvoltage for the cathode employed, for example, half-cell potentials in the range of from about −0.5 to about −3 volts versus a standard calomel electrode. Preferred cathode half-cell potentials are those in the range of from about −0.8 to about −2, and more preferably from about −1 to about −1.5.

When using a mercury cathode at half-cell potentials above about 3 volts, hydroxylamine nitrate may be reduced to ammonium nitrate according to the equation:

$$NH_2OH+HNO_3+2H^-+2e\rightarrow NH_4-+-NO_3-+H_2O \quad (6)$$

The actual hydrogen overpotential of a cathode depends on many factors including current density, local pH gradient, temperature, the concentration gradients of the catholyte, and particularly in using mercury cathodes, on the degree of contamination of the mercury surface with metal impurities. Because of these various factors, and despite the fact that the generation of hydrogen also results in the production of $OH^-$ ions which can decompose hydroxylamine nitrate, some generation of hydrogen gas can be tolerated in the process of the present invention.

The anolyte is an aqueous mineral acid solution capable of supplying protons to the catholyte. Suitable mineral acids include nitric acid, hydrochloric acid, phosphoric acid, sulfuric acid, perchloric acid, boric acid, and mixtures thereof. Preferred as an anolyte is a nitric acid solution since it will not introduce undesired impurities into the catholyte. Where the purity of the hydroxylamine nitrate product is not critical, other acids such as hydrochloric or sulfuric may be used as the anolyte, providing they do not introduce sufficient amounts of the anion into the catholyte solution to form the corresponding hydroxylamine salt. Concentrations of the acid in the anolyte are not critical and any suitable concentrations may be used. It is advantageous to maintain the concentration of the anolyte solution higher than the concentration of the nitric acid catholyte solution to prevent dilution of the catholyte with water. For example, it is desirable to maintain a ratio of the molar concentration of the anolyte to that of the excess nitric acid in the catholyte of at least 2 and preferably from about 6 to about 15. The anolyte is preferably continuously removed from and recirculated to the anode compartment with the concentration of the acid being adjusted as required.

The cell 10 of the present invention is operated at current densities suitable for producing concentrated solutions of hydroxylamine nitrate. For example, suitable cathode current densities include those in the range of from about 0.05 to about 10, preferably from about 0.2 to about 6, and most preferably from about 1 to about 4 kiloamperes per square meter.

Hydroxylamine nitrate solutions produced by the process of the present invention are of high purity. Hydroxylamine nitrate is however less stable than other hydroxylamine salts particularly at high temperatures. It is particularly important where the product solutions are to be concentrated, such as for example, where they use in a propellant, to carefully control the concentration of excess nitric acid in the product solution. This can be accomplished in one of several ways described in U.S. Pat. No. 4,849,073, assigned to the assignee of the present invention, and specifically incorporated by reference herein.

Materials of construction of the cell 10 are generally as described. The cell bottom 11 can employ Hastelloy C alloy, while other parts of the cell not previously specified can employ either steel or stainless steel 304 where the parts are not wetted and either coated steel or coated stainless steel 316 where they are wetted by fluids in the process. The coating should be a material that is not reactive with the process fluids, such as PFA, PVC or CPVC.

In order to exemplify the results achieved with the use of the process and the cell of the instant invention, the following example is provided without any intent to limit the scope of the instant invention to the specific discussion therein.

EXAMPLE

A 0.2 square meter electrolytic cell of the design shown generally in FIG. 3 was operated with a NAFION® 417 reinforced membrane, CPVC cell top and anode side frames, and PVC cathode side frames. The cell bottom employed Hastelloy® C alloy material. The cell was initially operated at about 1.5 kiloamperes per square meter at a catholyte temperature of about 10° C. The amperage was gradually increased from the initial 300 amps to about 450 amps and the cell was operated at a catholyte temperature of about 15° C.

A triple distilled mercury pool was utilized as the cathode. Copper strips are welded to each outside end of the HASTELLOY® C bottom plate to provide the electrical connection between the copper bus and the cathode. Anode assembly consisted of platinum-clad niobium mesh welded to 51 niobium blades that were welded in turn along the length of the niobium support channel's underside. About 0.045 grams of platinum was coated per square inch of mesh and a niobium boss was welded to each end of the channel's topside. A niobium post screwed into each anode boss to provide the electrical connection between the anode and the copper bus. 60-mil GORTEX® gasket seals were employed to seal the anode and cathode side frames. The anode side frame used EPDM O-ring seals in addition to the gaskets. The two clamping frames were bolted together with 26 tie bolts to provide the proper sealing pressure.

Catholyte was fed into the catholyte inlet header and then dispersed evenly over the cathode surface through 8 evenly spaced holes or inlet passages in the side frame. The catholyte exited in the gap between the membrane and the cathode through the outlet passages into the outlet end box where gas was vented out through the top of the end box, overflowed into a product line, and recirculating catholyte was returned via a heat exchanger and a static mixer for reconcentration with fresh nitric acid the cell. The product was gravity fed into a product drum. The product was filtered prior to being fed into the drum. The catholyte was cooled by an external cooling system utilizing a single-pass, polytetrafluorethylene heat exchanger through which catholyte and about a 50% chilled glycol solution passed countercurrently.

About 70% nitric acid was meter pumped from a storage tank into a static mixer inlet and quickly mixed with the recycled catholyte. Anolyte was pumped through the cell and into an overflow anolyte reservoir, passing perpendicularly to the catholyte direction of flow. The anolyte water was electrolyzed at the anode during operation and was electro-osmotically transported into the catholyte. The anolyte contained about 6 to about 7 molar nitric acid that provided a concentration gradient supporting osmotic water transport from the catholyte to the anolyte to minimize catholyte dilusion. The anode compartment and anolyte tank were vented to the atmosphere.

The opposing second higher outlet end passage the catholyte in the side frame was elevated about 7 millimeters higher than the first inlet end passage.

Average operating conditions and performance summary from five days of stable operation are given below in the following table.

TABLE I

Operating Conditions and Performance Summary

| | Average | Deviation |
|---|---|---|
| Loads (amps) | 450 | 4 |
| Catholyte flow (mL/s) | 580 | 1 |
| Anolyte flow (mL/s) | 199 | 3 |
| Anolyte Nitric Acid (Molar) | 6.0 | 0.1 |
| Catholyte acid (M) | 0.55 | 0.04 |
| Catholyte temp. (°C.) | 15 | 0.4 |
| Max hydroxylamine (Molar) | 3.67 | 0.1 |
| Voltage (volts) | 4.83 | 0.2 |
| Current efficiency (%) | 86-89 | |
| Ammonium Nitrate (Molar) | <0.006 | |

Representative catholyte and anolyte pressures during the run were about 14 to about 16 Kilopascals (KpA) catholyte pressure and about 8 KpA anolyte pressure. The differential pressure measured across the membrane was about 50 to about 60 centimeters of water or about 0.7 to about 0.85 pounds per square inch.

An analysis of metals in the electrolyte within the cell indicate that platinum levels in the anolyte rose steadily during the extended operation of the cell, accounting for an approximate 3% loss in the anode coating.

While the invention has been described above with reference to specific embodiments thereof, it is apparent that many changes, modifications and variations in the materials, arrangements of parts and steps can be made without departing from the inventive concept disclosed herein. For example, in employing the electrolytic cell design of the present invention, while the anolyte has previously been described as being circulated, it is not necessary to have the anolyte circulated as long as the concentration is periodically checked to ensure constant operating conditions. The anolyte need not be just an aqueous mineral acid, but could be any appropriate hydrogen ion containing electrolyte. Also, the process and cell disclosed herein can be used in any electrochemical process that requires the combination of reduction in a liquid metal cathode and a cation that is released at the anode and transported by the membrane into the catholyte where it is used in the reaction. Additionally the obliquely angled portion of the anode side frame, while shown as being angled inwardly into the cathode compartment, could also be angled outwardly toward the catholyte end boxes and still be effective to prevent incursion of the corrosive catholyte into contact with the cell bottom. Also, it may be possible to employ any other suitable type of a separator between the liquid metal cathode and the anode, including a diaphragm, in addition to the preferred membrane described herein. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

Having thus described the invention, what is claimed is:

1. A side frame for an electrolytic cell having a flowable liquid metal cathode in a cathode compartment, an anode, a membrane with a major portion thereof positioned in an extended plane therebetween and a catholyte inlet and catholyte outlet for the flow of catholyte into and out of the catholyte compartment in the cell comprising in combination:

(a) an obliquely angled lower internal side frame portion positioned below the catholyte inlet and the catholyte outlet; and (b) an upper side frame portion positioned above the catholyte inlet and the catholyte outlet.

2. The side frame according to claim 1 further comprising the obliquely angled lower internal portion being inwardly angled.

3. The side frame according to claim 2 further comprising the catholyte inlet and the catholyte outlet being generally horizontally positioned.

4. The side frame according to claim 3 further comprising the upper side frame portion having a recess into which an adjacent frame portion seats.

5. The side frame according to claim 4 further comprising the recess in the upper frame portion having a groove adaptable to receive the membrane for liquid-tight assembly.

6. The side frame according to claim 5 further comprising the groove being adaptable to receive a sealing means to seal the membrane, the upper frame portion and the adjacent frame portion.

7. The side frame according to claim 4 further comprising the recess in the upper frame portion having a groove adaptable to receive a ceiling means to seal the membrane against the upper frame portion and the adjacent frame portion.

8. The side frame according to claim 2 further comprising the obliquely angled side frame portion being contactable with the flowable liquid metal cathode.

9. An electrolytic cell having a flowable liquid metal cathode in a catholyte compartment, an anode, a separator, a catholyte inlet and catholyte outlet for the flow of catholyte into and out of the catholyte compartment in the cell comprising in combination:

(a) a cathode side frame having an obliquely angled lower internal side frame portion and an upper portion, the upper portion being separated from the obliquely angled lower internal portion by the catholyte inlet and catholyte outlet, the obliquely angled lower internal portion contacting and retaining the flowable liquid metal cathode within the catholyte compartment;

(b) an anode side frame sealably connectable to the upper portion of the cathode side frame;

(c) an anode adjacent frame;

(d) a separator contactable with and supportable by the anode and retained in position by the upper portion of the cathode side frame and the anode side frame, the separator further having a major portion thereof positioned in an extended plane between the liquid metal cathode and the anode; and (e) a gap defined by the flowable liquid metal cathode and the membrane in fluid flow communication with the catholyte inlet and the catholyte outlet through which the catholyte flows, the catholyte entering through the catholyte inlet and exiting through the catholyte outlet at a level above the major portion of the separator in the extended plane.

10. The cell according to claim 9 wherein the flowable liquid metal cathode is supported by a cell bottom which the catholyte is prevented from touching by the obliquely angled lower cathode side frame portion and the flowable liquid metal cathode.

11. The cell according to claim 10 wherein the catholyte inlet is lower than the catholyte outlet.

12. The cell according to claim 11 wherein the upper portion of the cathode side frame has a recess into which the anode side frame seats.

13. The cell according to claim 12 wherein the recess in the upper portion of the cathode frame has a groove adaptable to receive the separator for liquid-tight assembly.

14. The cell according to claim 13 wherein the groove has a sealing means to seal the separator, the upper portion of the cathode frame and the anode side frame.

15. The cell according to claim 14 wherein the separator further comprises a membrane.

16. The cell according to claim 14 wherein the membrane adjacent the catholyte inlet and the catholyte outlet is obliquely angled and above the gap.

17. The cell according to claim 12 wherein the recess in the upper portion of the cathode frame has a groove adaptable to receive a sealing means to seal the separator between the upper portion of the cathode in the anode side frame.

18. The cell according to claim 10 wherein the cell is angled from the horizontal at a grade of less than about 5 percent.

* * * * *